US006527632B1

(12) United States Patent
Dooley et al.

(10) Patent No.: US 6,527,632 B1
(45) Date of Patent: Mar. 4, 2003

(54) LAP HAVING A LAYER CONFORMABLE TO CURVATURES OF OPTICAL SURFACES ON LENSES AND A METHOD FOR FINISHING OPTICAL SURFACES

(75) Inventors: Jonathan M. Dooley, Bolton, CT (US); Michael Goulet, Hebron, CT (US); David J. Logan, Monterey, MA (US)

(73) Assignee: Gerber Coburn Optical, Inc., South Windsor, CT (US)

( * ) Notice: Subject to any disclaimer, the term of this patent is extended or adjusted under 35 U.S.C. 154(b) by 0 days.

(21) Appl. No.: 09/452,401

(22) Filed: Dec. 1, 1999

(51) Int. Cl.[7] ..... B24B 13/00
(52) U.S. Cl. ..... 451/504; 451/42; 451/53
(58) Field of Search ..... 451/504, 42, 53, 451/56, 494, 490

(56) References Cited

U.S. PATENT DOCUMENTS

| | | | |
|---|---|---|---|
| 296,370 | A | 4/1884 | Walker |
| 2,450,433 | A | 10/1948 | Leeman |
| 3,201,905 | A | 8/1965 | Snyder |
| 3,893,264 | A | 7/1975 | Behnke |
| 4,255,164 | A | 3/1981 | Butzke et al. |
| 4,831,789 | A | 5/1989 | Herbin et al. |
| 4,989,316 | A | 2/1991 | Logan et al. |
| 5,095,660 | A | 3/1992 | Dillon |
| 5,205,083 | A | 4/1993 | Pettibone |
| 5,345,725 | A | 9/1994 | Anthony |
| 5,577,950 | A | 11/1996 | Smith et al. |
| 5,593,340 | A | 1/1997 | Nelson et al. |
| 5,980,360 | A | 11/1999 | Murray et al. |

FOREIGN PATENT DOCUMENTS

| | | |
|---|---|---|
| EP | 0 655 297 | 5/1995 |
| EP | 0 779 128 A1 | 6/1997 |
| FR | 2 654 027 | 5/1991 |
| JP | 54-100591 | 8/1979 |
| JP | 63-278756 | 11/1988 |
| JP | 2-95557 | 4/1990 |
| JP | 5-57590 | 3/1993 |
| JP | 5-245767 | 9/1993 |
| JP | 10-29148 | 2/1998 |

*Primary Examiner*—Robert A. Rose
(74) *Attorney, Agent, or Firm*—McCormick, Paulding & Huber LLP

(57) ABSTRACT

In a conformable lap and related method for finishing ophthalmic lens surfaces, a rigid base surface of the lap defines a nominal ophthalmic lens curvature corresponding to a predetermined range of curvatures. A work surface of the lap is defined by a thin, hard, polymeric material extending adjacent to the base surface for contacting a selected ophthalmic lens surface and conforming to the curvature of the selected surface. A selectively conformable substance consisting of a mixture of thermoplastic and metallic particles forms a layer extending between the rigid base surface and the work surface, and is selectively changeable between solid and non-solid forms. In its non-solid form the conformable substance permits movement of the work surface relative to the base surface to conform to the curvatures of any one of a plurality of ophthalmic lens curvatures within the predetermined range of curvatures, and in its solid form the substance fixes the work surface in a position conforming to the curvature of a selected lens surface and retains the conforming position during finishing of the lens surface.

3 Claims, 4 Drawing Sheets

LAP HAVING A LAYER CONFORMABLE TO CURVATURES OF OPTICAL SURFACES ON LENSES AND A METHOD FOR FINISHING OPTICAL SURFACES

FIELD OF THE INVENTION

The present invention relates to an apparatus and method for finishing contoured optical surfaces in accordance with particular prescriptions, and more directly, to such apparatus and methods incorporating work surfaces which are selectively conformable to a broad range of optical surface curvatures for performing work operations on these surfaces.

BACKGROUND OF THE PRESENT INVENTION

Optical surfaces of eyeglass lenses are typically prepared in accordance with particular lens prescriptions that require the lens have that contours which provide selected focusing or other optical effects. The contours may be convex or concave, and a lens may be provided with both convex and concave surfaces that act together to produce the desired optical effect. Generally, the surface of an eyeglass lens proximate to the eye, is ground with a concave contour made up of compound curves. A toric surface is found on many ophthalmic lenses, and has the contours of a section of a toroid or donut. In general, there are two basic curvatures on a toric surface, one corresponding to the radius of the equator and the other corresponding to the radius of the tubular element forming the toroid. These two curvatures are referred to respectively as the "sphere" and the "cylinder", and together with the "axis" angle of the cylinder, the spherical curvature of the front surface and the index of refraction of the lens material define the prescription power of the lens.

Conventional methods for finishing the prescription surface of an ophthalmic lens utilize a lap having a specially contoured surface that substantially matches the contours of the desired prescription surface of a lens being finished. A thin finishing pad is attached to the contoured surface of the lap, typically by adhesive, and an abrasive material is either directed onto the pad in the form of a slurry or is incorporated into the pad itself. Typically, pads with an abrasive material bonded or otherwise integrated into them are referred to as fining pads and are used for coarser finishing operations. Fibrous pads without abrasives are used with a slurry containing fine abrasive materials are referred too as polishing pads. Unless otherwise specifically stated, the term "finishing pad" is utilized throughout this specification to refer to both types of pads, and the term "finishing" is used throughout this specification to refer to both types of operations.

Since the finishing pad in conventional finishing operations is relatively thin and must take its shape from the lap, the lap in turn must be ground with contours that essentially conform to the prescription or curvatures of the lens being finished. As a consequence, finishing laboratories must stock a large number of laps corresponding to the full range of prescriptions that are commonly required. Needless to say, a significant inventory of laps is needed.

Alternatively, an individual lap can be ground for each prescription as needed. U.S. Pat. No. 4,989,316 issued to Logan et al. and assigned to the Assignee of the present invention, describes a numerically-controlled machine for cutting a lens blank and a corresponding lap blank to be used in finishing the lens blank.

As a further alternative, the lens blank from which the eyeglass lens is formed can be coarsely ground to the desired prescription, and a conformable lap can be used as the tool for the finishing operation. A conformable lap in general has a work surface that is adapted to conform to the curvature of the contoured surface ground on the lens blank. Thus, during a finishing operation which may employ a fining or polishing pad with slurry, the coarseness of the contoured surface is removed but the general curvatures defined by the prescription are preserved. Conformable laps are shown in U.S. Pat. Nos. 4,831,789; 5,095,660; 5,345,725; and 5,593,340, French Patent No. 2654027 as well as European Application No. 0 655 297.

It is an object of the present invention to provide conformable laps which may conform to the contours of optical surfaces having a wide range of curvatures, and a related method for finishing such optical surfaces.

SUMMARY OF THE INVENTION

The present invention is directed to a conformable lap for finishing optical surfaces, such as ophthalmic lens surfaces, and to a related method for finishing such surfaces. The conformable lap comprises a rigid base surface defining a nominal curvature, such.as an ophthalmic lens curvature, corresponding to a predetermined range of curvatures. A work surface, preferably a-thin, hard, polymeric surface, extends adjacent to the base surface for contacting a selected optical surface and conforming to the curvature of the optical surface. A selectively conformable substance of the lap forms a layer extending between the rigid base surface and the work surface, and is selectively changeable between solid and non-solid forms. In its non-solid form, the selectively conformable substance permits movement of the work surface relative to the base surface to conform to the curvatures of any one of a plurality of optical surface curvatures within the predetermined range of curvatures, and in its solid form the substance fixes the work surface in a position conforming to the curvature of a selected optical surface and retains the conforming position during finishing of the selected optical surface.

In the preferred embodiment, the selectively conformable substance is a mixture of thermoplastic and other more thermally-conductive particles, such as aluminum, and is changeable from its solid to its non-solid form in response to the application of thermal energy thereto.

One feature of the present invention is that the temperature-controlled fluid is introduced through a discharge end of a fluid channel to change the conformable substance from solid to non-solid form and vice-versa. The discharge end includes at least one central opening to introduce relatively hot fluid to a substantially central portion of the base surface and a plurality of openings to introduce relatively cold fluid to side portions of the base surface. The discharge end of the present invention ensures that the conformable substance cools to accurately assume the shape of the lens.

One advantage of the present invention is that the conformable lap may rapidly and accurately conform to a selected optical surface curvature to accurately finish, for example, an ophthalmic lens surface. Another advantage of the present invention is that a limited number of conformable laps may be provided, wherein each lap may conform to any of a plurality of different ophthalmic lens curvatures within a predetermined range of curvatures.

Other advantages of the present invention will become apparent in view of the following detailed description and accompanying drawings.

DETAILED DESCRIPTION OF THE PREFERRED EMBODIMENT

Figure 1:
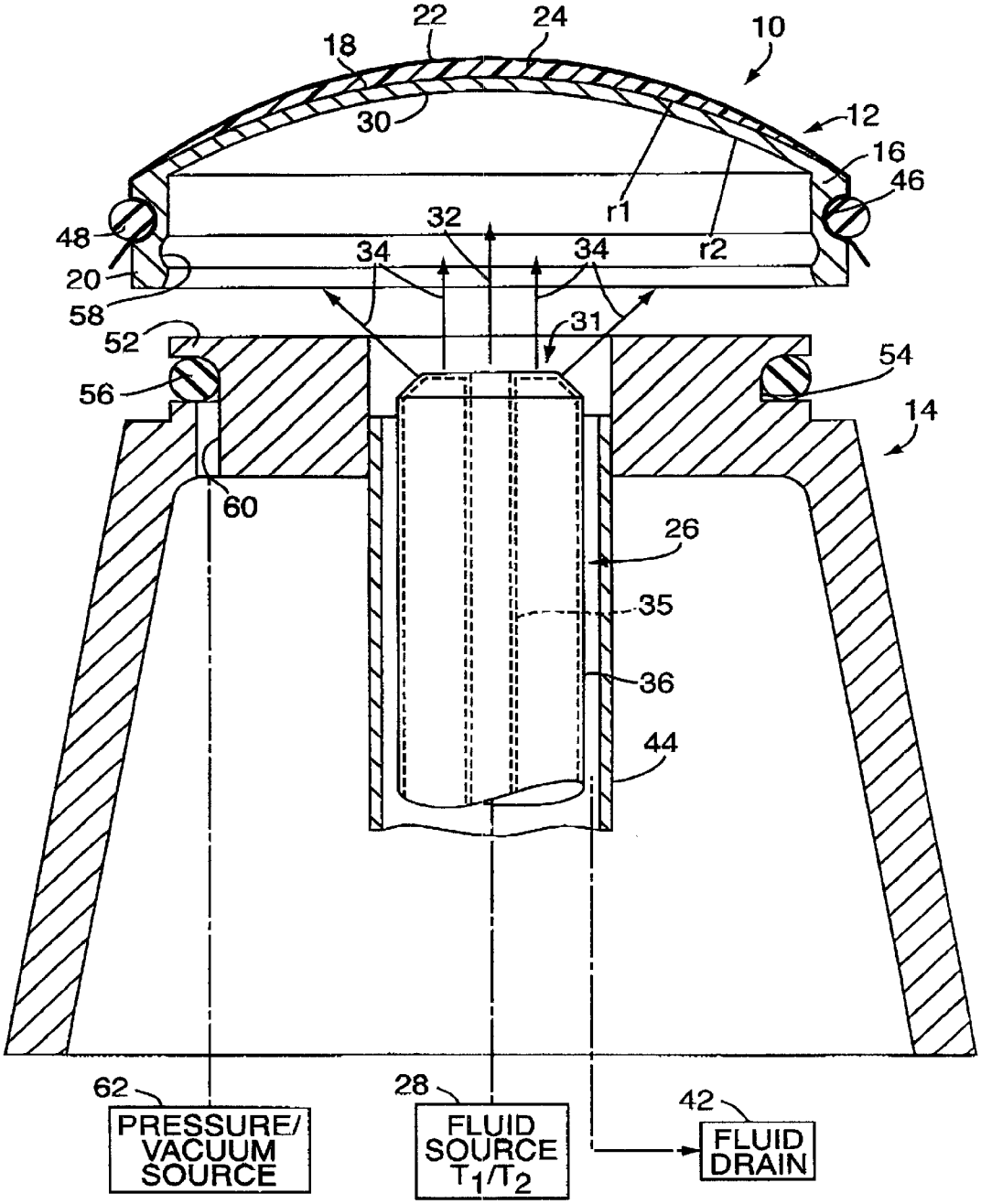
FIG. 1 is an exploded, partial schematic illustration of a conformable lap and a lap mount assembly embodying the present invention.

In FIG. 1, a conformable lap assembly embodying the present invention is indicated generally by the reference numeral 10. The lap assembly 10 includes a conformable lap 12 and a lap mount 14 for fixedly securing the conformable lap during set up and finishing operations. The conformable lap 12 comprises a base 16 defining a rigid base surface 18, and a mounting flange 20 depending from the periphery of the base surface. A work surface 22 is superimposed over the rigid base surface 18, and a selectively conformable substance 24 forms a layer extending between the work surface 22 and rigid base surface 18 which is selectively changeable between solid and non-solid forms. As is described further below, in its non-solid form the conformable substance 24 in its non-solid form permits movement of the work surface 22 relative to the base surface 18 to conform to the curvature of a selected optical surface, and in its solid form the substance 24 fixes the work surface 22 in a position conforming to the curvature of the selected optical surface and retains the conforming position during finishing of the optical surface. As also described further below, the base surface 18 defines a base or nominal ophthalmic lens curvature, and the layer of selectively conformable substance 24 allows the work surface 22 to conform to any of a plurality of different ophthalmic lens curvatures within a predetermined range of the nominal curvature.

The conformable substance 24 preferably includes a thermoplastic selectively changeable between solid and non-solid forms in response to the application of thermal energy thereto. Preferably, the thermoplastic is maintained in its solid form at the ambient temperature of the conformable lap and is changeable into its non-solid form in response to the application of thermal energy thereto.

In the currently preferred embodiment, the thermoplastic is of the type sold by the Assignee of the present invention under the trademark "Freebond™". Freebond™ thermoplastic exists in solid form at room temperature (about 70° F.), and changes into a non-solid liquefied state when heated to a temperature of approximately 122° F. Preferably, the conformable substance 24 comprises a mixture of Freebond™ thermoplastic and one or more other more thermally-conductive materials in order to enhance the thermal-conductivity of the substance, and in turn decrease the cycle times required to heat the substance from the solid to the non-solid form, and cool the substance from the non-solid to the solid form.

Accordingly, in the currently preferred embodiment of the invention, the selectively conformable substance 24 consists of Freebond™ thermoplastic and aluminum powder mixed in accordance with the following ratio: approximately 3.5 parts aluminum powder to approximately 1 part Freebond™ thermoplastic by weight. The aluminum powder is composed of approximately 20 micron spherical particles; however, other sizes and/or types of thermally-conductive additives may equally be employed. This preferred mixture has significantly improved thermal-conductivity, and therefore shorter heating and cooling cycle times in comparison to the Freebond™ thermoplastic itself. However, if desired, the metallic powder or other thermally-conductive additive may be eliminated, or different relative amounts of thermoplastic and conductive particles may be employed depending upon the specific thermal conductivity and/or other physical characteristics desired. In addition, although the Freebond™, or like thermoplastic is preferred, those skilled in the pertinent art may recognize based on the teachings herein that other thermoplastics may be employed. In addition, those skilled in the pertinent art may recognize based on the teachings herein that the selectively conformable substance 24 is not limited to the thermoplastic-types described, but may encompass other substances that are readily changeable between solid and non-solid forms by the application of, for example, heat, radiation, chemical or mechanical energy.

Figure 2:
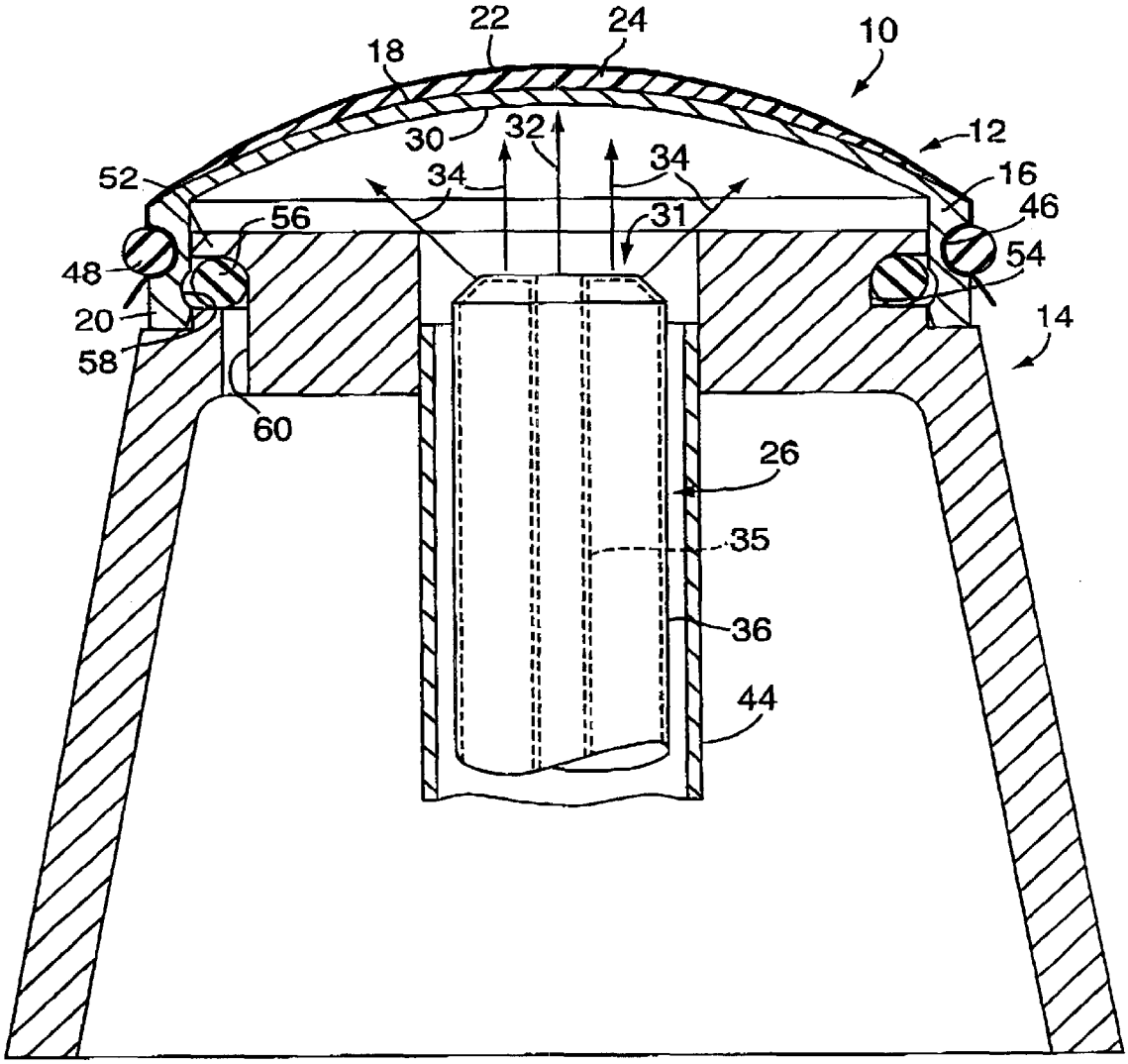
FIG. 2 is a schematic view of the assembled conformable lap and lap mount of FIG. 1.

In the conformable lap assembly 10, the substance 24 is selectively changed between its solid and non-solid forms by a temperature-controlled fluid, preferably water, coupled in thermal communication with the base surface 18 of the lap to control the temperature of the base surface and, in turn, control the temperature of the substance 24 in thermal communication with the base surface. As shown in FIG. 1, the lap mount 14 includes at least one fluid channel 26 connected in fluid communication with a temperature-controlled fluid source 28. During set up, the conformable lap 12 is fixedly secured to the lap mount 14, as shown in FIG. 2 and described further below, and the fluid source 28 is actuated to direct the temperature-controlled fluid, preferably water, through the conduit 26 and onto an underside 30 of the base surface 18. As shown in FIG. 1, the underside 30 of the base surface 18 is convex shaped and defined by a first radius "r1". A discharge end 31 of the fluid channel 26 is spaced immediately below the approximate center of the underside 30, and as indicated by the arrows 32, 34 in FIGS. 1 and 3, the temperature-controlled fluid flows onto the convex surface of the underside 30 to rapidly contact and either heat or cool the entire surface, respectively. The lap base 16 (or at least the portion defining the base surface 18) is formed of a material having relatively high thermal conductivity, such as aluminum, in order to decrease the heating and cooling cycle times of the lap.

Figure 3:
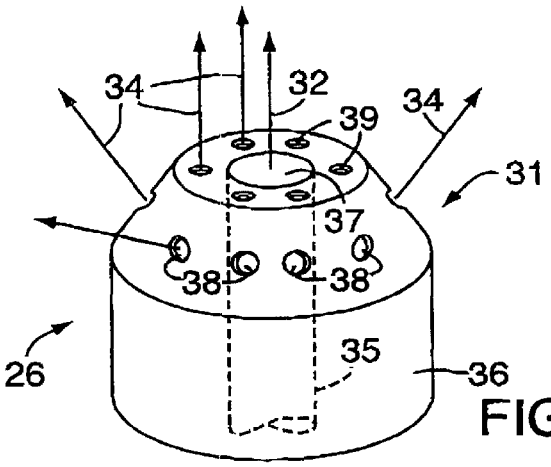
FIG. 3 is a perspective view of a discharge end of a conduit for introducing fluid into the conformable lap of FIG. 2.

Referring to FIGS. 1 and 2, the fluid channel 26 includes a hot fluid pipe 35 and a cold fluid pipe 36, substantially concentric with the hot fluid pipe 35. Referring to FIG. 3, the discharge end 31 of the fluid channel 26 includes at least one hot fluid opening 37 and a plurality of cold fluid openings 38, 39. The hot fluid opening 37 is in communication with the hot fluid pipe 35 and is substantially centrally located such that the hot fluid 32 is directed approximately toward the center of the underside surface 30, as also indicated by arrows 32 in FIGS. 1 and 2. The hot fluid disperses and heats the surface 30. The cold fluid openings 38, 39 are in fluid communication with the cold fluid pipe 36 and are directed toward the center of the underside surface 30 and toward outer sides of the surface 30 such that the cold fluid 34 cools the underside surface 30. In the preferred embodiment of the present invention, the cold fluid openings 38 are formed at a substantially 45° (forty-five degree) angle. As seen in FIG.

1, fluid drain 42 is coupled through at least one drain pipe 44 to receive and dispose of (or, if desired, re-circulate) the temperature-controlled fluid after passage through the interior of the lap mount. The drain pipe 44 is substantially concentric with the hot and cold fluid pipes 35, 36.

In the preferred embodiment of the invention, the conformable substance 24 is changed into its non-solid form by introducing relatively hot water at a temperature T1 through the discharge end of the conduit 26 to thereby heat the base surface 18 and the layer of conformable substance 24 to approximately the same temperature. Thus, for the Freebond™ type substance 24 described above, the temperature T1 should be at least approximately 122° F. This fluid temperature is sufficient to rapidly heat, and in turn change the preferred substance 24 from its solid to non-solid form. In the preferred embodiment, water at approximately 150° F. directed through the discharge end of the conduit 26 changed the preferred substance 24 from its solid to non-solid form within about 10 to 15 seconds. Then, after conforming the work surface 22 to the curvature of a selected optical surface, as described further below, water at temperature of approximately 40 to 50° F. directed through the discharge end 31 of the conduit 26 changed the preferred substance 24 from its non-solid to its solid form within about 5 to 10 seconds.

The present inventors have discovered that any deflection in the work surface 22, or any relative movement between the work surface and the layer of conformable substance 24 should be minimized, and preferably eliminated, in order to produce finished lenses of sufficient optical quality. Accordingly, the work surface 22 is made of a relatively thin, hard and stiff material in order to minimize, and preferably eliminate any deflection of the work surface during finishing operations. In the currently preferred embodiment of the invention, the work surface 22 is made of a thin polymeric material, preferably vinyl, having a thickness within the range of approximately 4 to 8 mils. This, in combination with the properties of the preferred Freebond™-type substance 24, substantially prevents any deflection in the work surface 22 and relative movement between the work surface and the layer 24.

As shown best in FIG. 1, the depending flange 20 of the lap base 16 has a peripheral groove 46 for receiving the polymeric sheet of the work surface 22 and an elastomeric o-ring 48 overlying the sheet within the groove. During assembly, the polymeric sheet forming the work surface 22 is superimposed over the layer of conformable substance 24, and pulled downwardly about the depending flange 20 of the lap base 16. Then, the elastomeric o-ring 48 is rolled or otherwise slipped over the flange 20 and received within the peripheral groove 46 to fixedly secure the polymeric sheet to the lap. The elastomeric ring 48 is dimensioned to form a sufficiently tight fit within the groove 46 to fixedly secure the polymeric sheet to the lap throughout set up and finishing operations. As will be recognized by those skilled in the pertinent art based on the teachings herein, other mechanisms or structures may equally be employed to fixedly secure the work surface 22 to the lap base 16. For example, the sheet forming the work surface 22 could be attached to the lap by an adhesive, by welding, or by any of numerous known fasteners for fixedly securing the sheet to the base.

Figure 4:
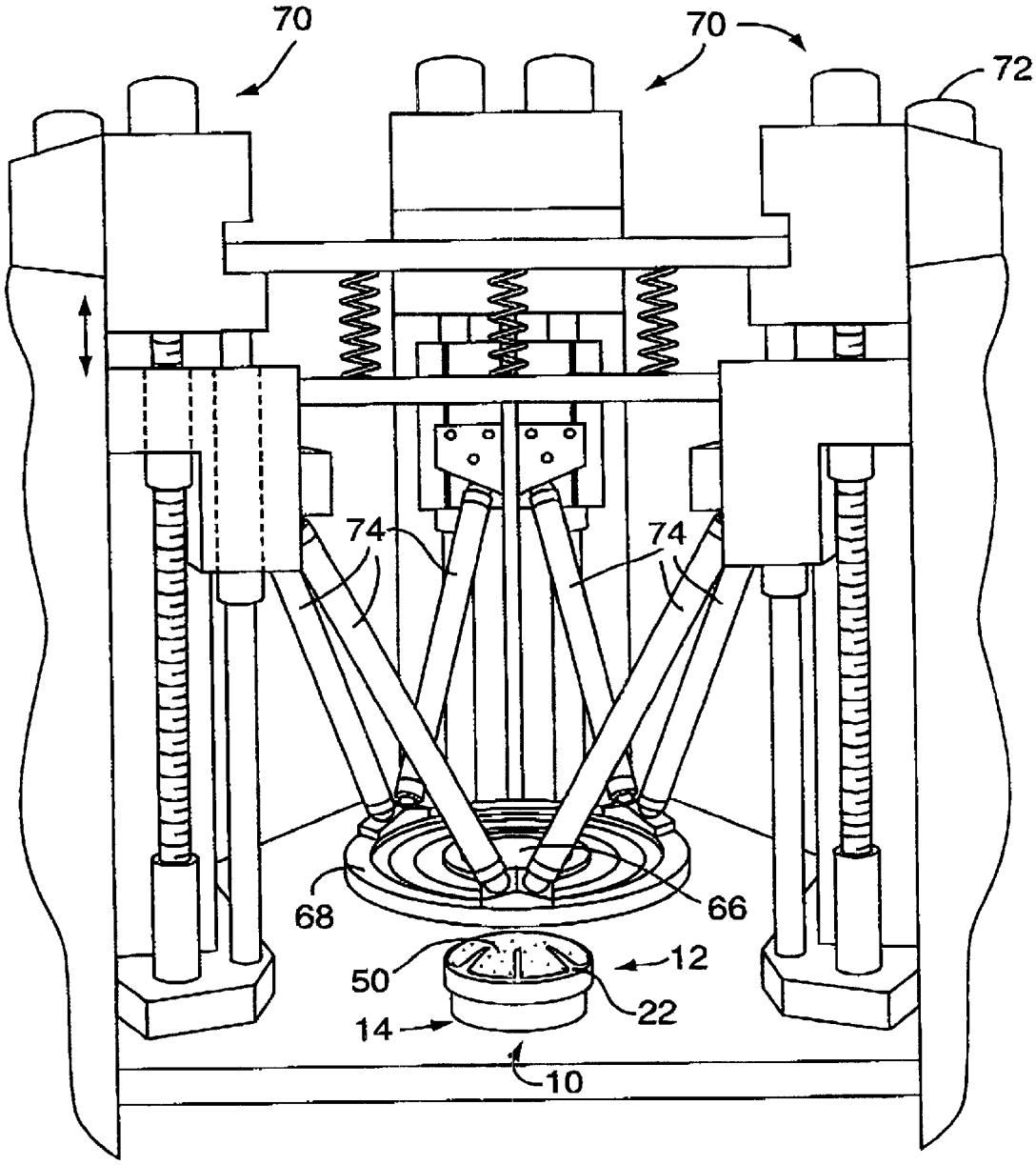
FIG. 4 is a partial schematic illustration of the assembly of FIG. 2 showing the conformable lap fixedly secured to the lap mount in a finishing machine.

As shown in FIG. 4, a finishing pad 50 is superimposed on, and attached to the work surface 22 to further define the work surface for finishing eyeglass lenses. The finishing pad 50 may be formed in accordance with any of numerous known finishing pads which are commercially available for fining and/or polishing optical surfaces. Accordingly, the finishing pad 50 may have an abrasive material, such as a silicone carbide grit, bonded or otherwise integrated into the pad to form the work surface for fining the selected optical surface. An exemplary finishing pad is provided in the form of a slotted disk, and may be of the type disclosed in U.S. Pat. No. 4,255,164 to Butzke et al. For polishing, on the other hand, the pad 50 may be in the form of a fibrous finishing pad without abrasives (e.g., a non-woven fabric, such as felt) which may be used with a slurry, if necessary, introduced at the interface of the optical and work surfaces.

The finishing pad or like work surface 50 is superimposed on, and attached to the work surface 22 by any of numerous means for attaching or joining known to those of ordinary skill in the pertinent art. Preferably, the finishing pad 50 is attached to the underlying work surface 22 by an adhesive, or a double-sided fastening tape, which fixedly secures the finishing pad in place and prevents any relative movement between the pad and underlying surface during finishing operations. Preferably, the conformable lap 12 includes means for interchangeably attaching the finishing pad or like member 50 to the underlying work surface 22. For example, the underside of the finishing pad 50 may include a double-sided adhesive or other fastening tape (e.g., Velcro™), or other means for fastening or joining and permitting the finishing pad to be attached to, and detached from the underlying work surface 22 without tools. As an alternative to the finishing pad 50, the work surface 22 may define the desired surface characteristics for finishing an optical surface. However, the interchangeable finishing pads 50 are currently preferred.

As shown in FIGS. 1 and 2, the lap assembly 10 further includes means for detachably mounting the conformable lap 12 to the lap mount 14. The lap mount 14 has an upstanding flange 52 which is dimensioned to be slidably received within the depending flange 20 of the lap base 16. The upstanding flange 52 defines a peripheral groove 54 receiving an elastomeric o-ring 56. The depending flange 20 of the lap base 16 similarly defines an annular groove 58 on its interior surface which is aligned with the peripheral groove 54 when the conformable lap 12 is seated on the mount 14. The peripheral groove 54 is coupled in fluid communication by a conduit 60 to a pressure/vacuum source 62. In order to fixedly secure the conformable lap 12 to the lap mount 14, the pressure/vacuum source 62 is actuated to introduce pressurized gas, preferably air, into the conduit 60 which, as indicated in broken lines in FIG. 1, pushes the elastomeric ring 56 outwardly and into the annular groove 58 of the lap base 16 to thereby lock the conformable lap to the mount. Then, in order to release the conformable lap 12 from the mount 14, the pressure/vacuum source 62 is actuated to draw vacuum through the conduit 60 which, in turn, draws the elastomeric ring 56 inwardly away from the annular groove 58 of the lap base 16. With the vacuum source actuated, the conformable lap 12 may be easily lifted away from the mount 14.

In FIG. 4, the conformable lap assembly 10 is mounted in an apparatus for finishing the contoured optical surface of an eyeglass lens blank 66. In this type of apparatus, the lens blank 66 is joined by an adhesive, mechanical fastener, or other suitable joining mechanism to a mounting bracket or lens holder 68 located within a tub or like receptacle (not shown) for performing the finishing operations. Preferably, the lap mount 14 is fixedly secured to a support surface of the apparatus with the lens holder 68 and lens 66 supported above the conformable lap 12. As shown in FIG. 3, the work surface 22 of the conformable lap 12 defines a diameter less than the diameter of the optical surface 64 in order to permit the work surface to adopt the signature (i.e., conform to the curvature) of the optical surface.

The lens holder 68 is driven by a suitable drive system 70 along a predetermined path in accordance with commands issued by a controller 72. The controller 72 is electrically connected to each of the components of the assembly, including the fluid source 28, the pressure/vacuum source 62 (shown in FIG. 1) and the drive system 70, in order to automatically control each component for performing the set up and finishing operations. The path of the lens 66 and lens holder 68 may be orbital, as described in U.S. Pat. No. 3,893,264, or may have a linear, arcuate or other desired configuration. Preferably, however, the path is defined by the curvatures of the selected lens surface in order to accurately reproduce the curvatures in the finished lens.

FIG. 4 illustrates an exemplary apparatus for finishing an optical surface in this manner and is disclosed in U.S. Pat. No. 5,987,360, entitled "Method and Apparatus for Performing Work Operations on a Surface of One or More Lenses", which is assigned to the Assignee of the present invention, and is hereby expressly incorporated by reference as part of the present disclosure. In this apparatus, the drive system 70 comprises at least three pairs of articulated supports 74, which are angularly spaced relative to each other, and connected to the lens holder 68 for moving the lens holder and lens in virtually any predetermined direction under commands issued by the controller 72 to set up the conformable lens and finish the optical surface, as hereinafter described.

Figure 5:
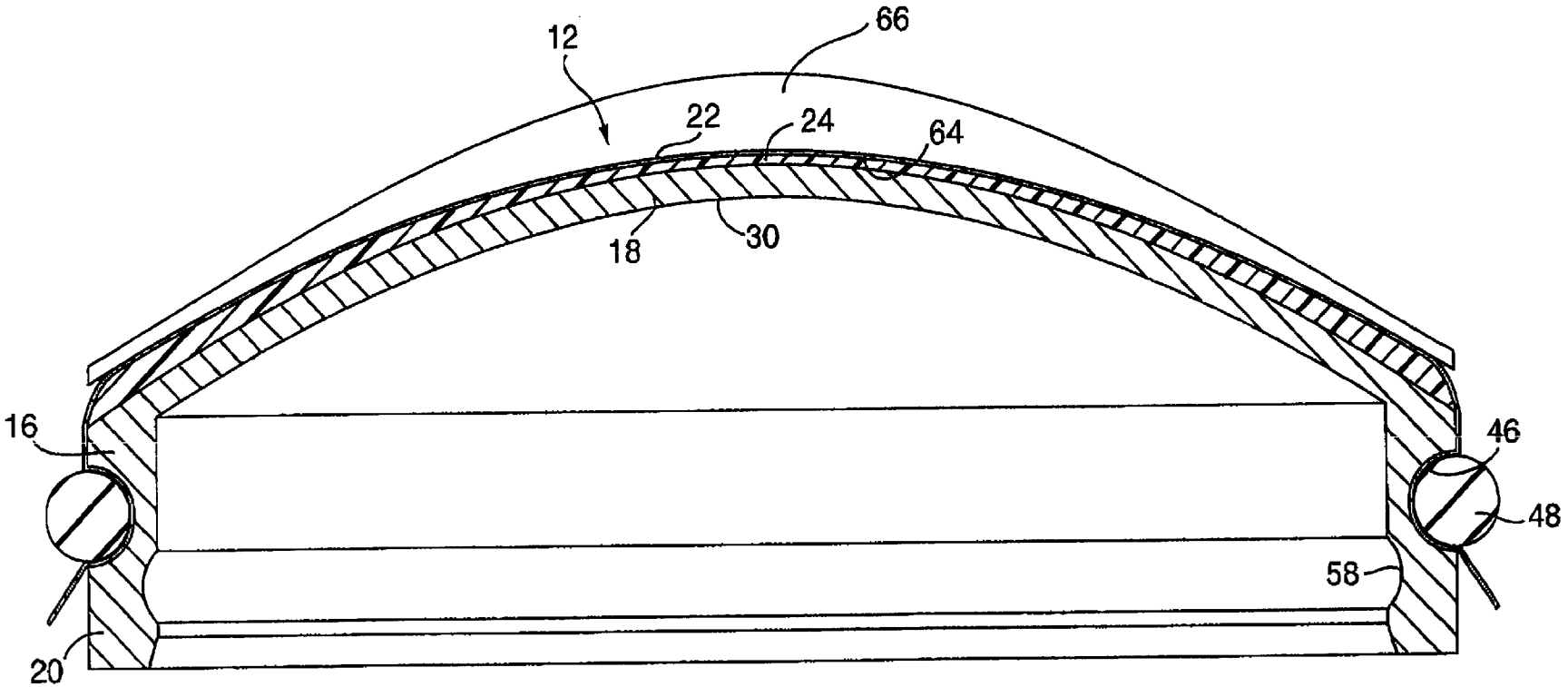
FIG. 5 is an enlarged view of the conformable lap of FIG. 2 with a selected lens placed thereon.

In the operation of the present invention, the apparatus of FIG. 4 is set up to finish a selected lens 66 by fixedly mounting the lens to the lens holder 68. Then, the conformable lap 12 is prepared to conform to the curvature of a selected lens surface 67 of the selected lens 66. First, with the lens 66 spaced above the work surface 22 of the lap, the controller 72 actuates the fluid source 28 to introduce relatively warm water at the temperature T1 through the discharge end 31 of the fluid channel 26, FIG. 2, and into contact with the underside 30 of the lap base 16. As described above, in the preferred embodiment, water at approximately 150° F. may change the Freebond-type substance 24 from its solid to non-solid form within several seconds. Then, with the layer of selectively conformable substance 24 in its non-solid form, the control computer 72 actuates the drive system 70 to move the lens holder 68 downwardly, and in turn press the lens surface 67 into contact with the work surface 22, as shown in FIG. 5. Because the intermediate layer 24 is in its non-solid form, the work surface 22 is permitted to exactly conform to the curvatures of the optical surface 64. Referring to FIG. 5, as the lens 66 is pressed into contact with the work surface 22 of the lap, the conformable substance 24 is redistributed forming a relatively thinner layer in the center portion thereof.

Once the optical surface 67 is pressed into conforming contact with the work surface 22, the control computer actuates the fluid source 28 to introduce relative cool fluid through the discharge end 31 of the conduit 26 and into contact with the side portions of the underside 30 of the base surface 18 to change the layer of conformable substance 24 from its solid to non-solid form. As described above, in the currently preferred embodiment, water at a temperature of approximately 40 to 50° F. may change the preferred substance 24 from its non-solid to solid form within several seconds. As the cool fluid 34 initially comes into contact with the side portions of the surface 30, cooling of the side portions begins first in order to ensure that thicker layer of the redistributed conformable substance 24 is adequately cooled and that the conformable lap accurately assumes the shape of the lens surface 67.

With the layer of conformable substance 24 in its solid form, and thus the work surface 22 locked in the position conforming to the curvature of the selected optical surface, the drive system 70 is actuated to move the lens holder 68 away from the conformable lap 12 to thereby release the lens 66 from the lap. If necessary to facilitate removal of the lens 66 from the work surface 22 due to vacuum created between the lens and lens surface, a fine thread may be interposed between the lens and work surface prior to formation of the work surface curvatures to prevent the formation of any vacuum. Any indentation created by the fine thread will not affect performance of the lap.

Once the lens is removed from the work surface 22, the finishing pad 50 is superimposed on, and attached to the work surface in a manner as described above for fining and/or polishing the optical surface. Because the work surface 22 defines the curvatures of the selected optical surface 67, the finishing pad 50 slightly changes the curvatures. In order to accurately reproduce the selected curvatures in the finished lens, the lens is placed onto the pad 50 for slightly reconforming the conformable substance 24. Thus, the conformable substance is reconformed to compensate for the thickness of the pad 50. In the preferred embodiment, compensating for the thickness of the pad does not require a full cycle of changing the conformable substance 24 from its solid to non-solid form. Also, water is directed onto the pad.

The controller 72 then actuates the drive system 70 to move the lens holder 68 and lens 66 mounted thereon into contact with the finishing pad 50, and in turn move the lens holder and lens through the predetermined drive path to create relative movement at the interface of the lens surface 67 and finishing pad 50 to thereby finish the lens. The finishing pad 50 may initially take the form of a conventional fining pad to fine the optical surface. Then, when the fining is complete, the fining pad 50 may be removed from the work surface 22 and replaced with a conventional polishing pad to polish the optical surface 67. Once the finishing operations are complete, the pads may be discarded, and the operations repeated for another lens.

The present inventors have discovered that it may be desirable to provide a plurality of conformable laps, wherein each lap defines a different nominal ophthalmic lens curvature. In addition, the nominal curvature in combination with the thickness of the layer of conformable substance 24 is set for each lap 12 to accommodate a plurality of different ophthalmic lens curvatures within a respective predetermined range of curvatures. One advantage of providing a group of laps in this manner is that the thickness of the layer of conformable substance 24 may be reduced in comparison to a single lap designed to accommodate a broader range of ophthalmic lens curvatures. As a result, the heating and cooling cycles times may be reduced, and to a lesser extent, the effect of any shrinkage in the layer of conformable substance upon transition from the non-solid to solid form may be minimized.

In the currently preferred embodiment of the invention, a family of different laps of the type shown in FIGS. 1–5 can be provided in order to accommodate a range of different lens curvatures from approximately 0 to 20 diopters ("D"). In this case, each conformable lap 12 is designed to accommodate an approximately 1.5 (one and a half) diopter range of lens curvatures as follows:

| LAP NO. | RANGE OF CURVATURE |
|---|---|
| 1 | 0–1.5D |
| 2 | 1.5D–3D |
| 3 | 3D–4.5D |
| 4 | 4.5D–6D |
| 5 | 6D–7.5D |
| 6 | 7.5D–9D |
| 7 | 9D–10.5D |
| 8 | 10.5D–12D |
| 9 | 12D–13.5D |
| 10 | 13.5D–15D |
| 11 | 15D–16.5D |
| 12 | 16.5D–18D |
| 13 | 18D–19.5D |
| 14 | 19.5D–21D |

In this currently preferred embodiment, each conformable lap 12 can handle a range from nominal to −1.5 (negative one and a half) diopters and achieve the approximate heating and cooling cycle times set for the above. Each lap can also accommodate a cylinder on the order of a 1.5 (one and a half) add (e.g., −4.5×6 on a 6D lap (Lap No. 4 above)). In addition, the cylinder need not be symmetrical about the mean of the add, but rather the total add may be to one side of the nominal curvature. Accordingly, the family of 14 (fourteen) conformable laps summarized above may conform to and finish any lens curvature up to 21 diopters (with as much as a 1.5 add). Additionally, some lenses require a cylinder or cross curve in addition to the base curve. The lap could have some preset amount of cylinder curve.

However, as will be recognized by those skilled in the pertinent art based on the teachings herein, the nominal curvatures set forth above, and the predetermined range of curvatures for each conformable lap are only exemplary, and may be changed as desired depending upon any of a variety of factors, including the desired heating and cooling cycle times.

Additionally, in the preferred embodiment of the present invention, the working surface of the conformable lap is smaller than the diameter of the lens to be polished. As is known in the art, for higher diopter laps, a special high diopter lap or raised lap is used.

As will be recognized by those of ordinary skill in the pertinent art, numerous changes and modifications may be made to the above-described and other embodiments of the invention without departing from its scope as defined in the appended claims. Accordingly, this detailed description of preferred embodiments is to be taken in an illustrative, as opposed to a limiting sense.

What is claimed is:

1. A conformable lap for finishing optical surfaces, comprising:

a rigid base surface defining a base curvature;

a work surface extending adjacent to the base surface for contacting a selected optical surface and conforming to the curvature of the selected optical surface;

a selectively conformable substance forming a layer extending between the rigid base surface and the work surface and selectively changeable between solid and non-solid forms, wherein the substance in its non-solid form permits movement of the work surface relative to the base surface to conform to the curvature of the selected optical surface, and the substance in its solid form fixes the work surface in a position conforming to the curvature of the selected optical surface and retains said conforming position during finishing of the selected optical surface;

wherein the selectively conformable substance includes a thermoplastic which is in its solid form at or below approximately the ambient temperature of the lap and is changeable into its non-solid form in response to the application of thermal energy thereto;

wherein said conformable lap further comprises means for controlling the temperature of the substance for selectively changing the substance between the solid and non-solid forms;

wherein the rigid base surface is formed of a thermally-conductive material, and the means for controlling the temperature of the substance includes means for introducing a temperature-controlled fluid into thermal communication with the base surface for controlling the temperature of the base surface and, in turn, controlling the temperature of the conformable substance in thermal communication with the base surface; and wherein the means for introducing a temperature-controlled fluid includes a discharge end having at least one opening for introducing relatively hot fluid to an approximately central portion of the base surface and a plurality of openings for introducing relatively cold fluid to central and side portions of the base surface.

2. A conformable lap for finishing optical surfaces, comprising:

a rigid base surface defining a base curvature;

a work surface extending adjacent to the base surface for contacting a selected optical surface and conforming to the curvature of the selected optical surface;

a selectively conformable substance forming a layer extending between the rigid base surface and the work surface and selectively changeable between solid and non-solid forms, wherein the substance in its non-solid form permits movement of the work surface relative to the base surface to conform to the curvature of the selected optical surface, and the substance in its solid form fixes the work surface in a position conforming to the curvature of the selected optical surface and retains said conforming position during finishing of the selected optical surface;

wherein the selectively conformable substance includes a thermoplastic which is in its solid form at or below approximately the ambient temperature of the lap and is changeable into its non-solid form in response to the application of thermal energy thereto;

wherein said conformable lap further comprises means for controlling the temperature of the substance for selectively changing the substance between the solid and non-solid forms;

wherein the rigid base surface is formed of a thermally-conductive material, and the means for controlling the temperature of the substance includes means for introducing a temperature-controlled fluid into thermal communication with the base surface for controlling the temperature of the base surface and, in turn, controlling the temperature of the conformable substance in thermal communication with the base surface;

wherein the means for introducing a temperature-controlled fluid includes at least one fluid channel coupled in fluid communication with the base surface, and a temperature-controlled fluid source coupled in fluid communication with the at least one conduit for introducing a temperature-controlled fluid into thermal communication with the base surface to thereby control the temperature of the base surface;

wherein the means for introducing a temperature-controlled fluid includes a hot fluid pipe and a cold fluid pipe; and wherein the hot fluid pipe and the cold fluid pipe are substantially concentric.

3. A conformable lap as defined in claim 2, further comprising a drain pipe disposed substantially concentric with the hot and cold fluid pipes to allow fluid to drain after being in communication with the underside of the conformable lap.

* * * * *